US010236167B1

(12) United States Patent
Noda

(10) Patent No.: US 10,236,167 B1
(45) Date of Patent: Mar. 19, 2019

(54) PEAK WAVEFORM PROCESSING DEVICE

(71) Applicant: SHIMADZU CORPORATION, Kyoto-shi, Kyoto (JP)

(72) Inventor: Akira Noda, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/891,641

(22) Filed: Feb. 8, 2018

(51) Int. Cl.
*H01J 49/00* (2006.01)
*H01J 49/40* (2006.01)

(52) U.S. Cl.
CPC ..... *H01J 49/0036* (2013.01); *H01J 49/40* (2013.01)

(58) Field of Classification Search
CPC ..... H01J 49/0036; H01J 49/40
USPC ..... 250/281, 282
See application file for complete search history.

(56) References Cited

FOREIGN PATENT DOCUMENTS

| | | | |
|---|---|---|---|
| JP | 2007-309661 | A | 11/2007 |
| JP | 2014222165 | A | 11/2014 |
| WO | 2014091243 | A1 | 6/2014 |

OTHER PUBLICATIONS

Gijutsu Bunrui 2-4-1-3 Shituryou Bunseki Zenpan Gijutsu/Deeta Shori/Supekutoru Shori/Piiku Kenshutsu (Technical Classification 2-4-1-3: General Techniques for Mass Spectrometry/Data Processing/Spectrum Processing/Peak Detection), [online], Japan Patent Office, [accessed on Aug. 3, 2015], the Internet, pp. 165-176.
Communication dated Nov. 13, 2018, from Japanese Patent Office in counterpart application No. 2015-154374.

*Primary Examiner* — Nicole Ippolito
*Assistant Examiner* — Hanway Chang
(74) *Attorney, Agent, or Firm* — Sughrue Mion, PLLC

(57) ABSTRACT

An upsampler 22 performs upsampling based on actual measurement data forming a profile spectrum obtained with a time-of-flight mass spectrometer 1, to insert interpolation data between the temporally adjacent actual measurement data and make the waveform smoother. Subsequently, a peak waveform processor 23 determines the centroid position, peak area or other relevant values by performing centroid processing which employs trapezoidal approximation or similar technique. The smoothing of the waveform between adjacent measurement data improves the accuracy of the centroid processing, whereby a systematic error in the estimation of the centroid position or calculation of the peak area is reduced. Therefore, even when the number of data points forming one peak on a measured waveform is small, the centroid position and other kinds of peak information can be obtained with a high level of accuracy, and the performance of qualitative or quantitative determination is thereby improved.

2 Claims, 4 Drawing Sheets

PEAK WAVEFORM PROCESSING DEVICE

TECHNICAL FIELD

The present invention relates to a peak waveform processing device for processing a peak waveform which emerges in a measured waveform, such as a chromatogram obtained with a liquid chromatograph or a profile spectrum obtained with a mass spectrometer, to obtain peak information, such as a centroid position or peak-top position.

BACKGROUND ART

When a measurement over a predetermined range of mass-to-charge ratios (m/z) is performed in a mass spectrometer, a profile spectrum is normally obtained as a measured waveform which shows the change in the ion intensity over that mass-to-charge-ratio range. Typically, in this profile spectrum, the intensity signal which corresponds to an ion originating from one substance emerges in the form of a peak having a certain mass-to-charge-ratio width. Accordingly, centroid processing for calculating the centroid of each peak on the profile spectrum is generally performed to determine the mass-to-charge-ratio value corresponding to the ion and create a mass spectrum in which a linear peak is drawn at the position of the determined mass-to-charge-ratio value (see Patent Literature 1 or Non Patent Literature 1).

A technique which employs trapezoidal approximation is frequently used as an algorithm for calculating the centroid position of the peak (i.e. m/z value) and the peak intensity value in the centroid processing. FIG. 7 is a schematic diagram illustrating this algorithm.

In FIG. 7, the points Pr indicated by the black dots (•) are data actually obtained by a measurement. Actual measurement data Pr which are adjacent to each other on the mass-to-charge-ratio axis are connected by line segments, and each intersection point Pt is determined between the line segments and the threshold level which is determined based on the peak-top value, i.e. the largest value among the actual measurement data values forming one peak. As shown in FIG. 7, the intersection point Pt is located on each of the rising and falling sides of the peak. A perpendicular line is dropped from each of the two intersection points Pt on the threshold line as well as each of the actual measurement data Pr equal to or higher than the threshold, onto the baseline, to determine the point of intersection of each perpendicular line and the baseline. A plurality of trapezoids are thereby formed, with their parallel sides formed by the perpendicular lines and their non-parallel sides formed by the baseline and the line segments connecting the actual measurement data Pr. A total of five trapezoids are obtained in the example of FIG. 7. The centroid of the polygon obtained by combining those trapezoids is calculated, and the value of the mass-to-charge ratio at which the centroid of the polygon is located is chosen as the centroid mass-to-charge-ratio value. Additionally, the centroid intensity value is calculated by totaling the areas of the trapezoids.

For example, in a liquid chromatograph ion trap time-of-flight mass spectrometer (LC-IT-TOFMS) in which a liquid chromatograph (LC) or other types of chromatograph is combined with an ion trap time-of-flight mass spectrometer, if all compounds separated by the LC and successively introduced into the IT-TOFMS must be completely detected, a measurement covering a predetermined time-of-flight range (i.e. a predetermined mass-to-charge-ratio range) must be repeated at short intervals of time in the IT-TOFMS. In that case, the duration of one peak on the time-of-flight spectrum obtained by a single measurement in the IT-TOFMS becomes short, and accordingly, the number of points of the actual measurement data forming one peak becomes small.

CITATION LIST

Patent Literature

Patent Literature 1: JP 2007-309661 A

Non Patent Literature

Non Patent Literature 1: "Gijutsu Bunrui 2-4-1-3 Shituryou Bunseki Zenpan Gijutsu/Deeta Shori/Supekutoru Shori/Piiku Kenshutsu (Technical Classification 2-4-1-3: General Techniques for Mass Spectrometry/Data Processing/Spectrum Processing/Peak Detection)", [online], Japan Patent Office, [accessed on Aug. 3, 2015], the Internet

SUMMARY OF INVENTION

Technical Problem

In the case where the centroid processing is performed by an algorithm which employs trapezoidal approximation in the previously described manner, if the number of points of the actual measurement data forming one peak is small, a significant error may occur between the actual position of the centroid and the estimated position of the centroid determined by the calculation. FIG. 8 shows a graph in which the horizontal axis indicates the amount of shift of the actual peak-top position which was gradually shifted within the sampling period with which the detection signals from a detector were sampled and converted into digital values, while the vertical axis indicates the centroid position determined by the calculation based on the previously described algorithm. Ideally, the centroid position should be constantly located at the same position regardless of the amount of shift of the peak-top position. However, the estimated position of the centroid in the present example is considerably varied within a range of 1.38-1.40. That is to say, in the conventional method mentioned earlier, a systematic error depending on the actual peak-top position occurs in determining the centroid position.

In general, TOFMS can provide a higher level of mass accuracy than quadrupole mass spectrometers or other types of mass analyzers. Taking advantage of its high mass accuracy, the device is often used for the identification (qualitative determination) of unknown substances. However, if there is a large systematic error of the centroid position or peak-top position as described earlier, the identification of a substance based on the mass-to-charge-ratio value will not be satisfactorily performed.

The present invention has been developed to solve such a problem. Its objective is to provide a peak waveform processing device capable of accurately performing the centroid processing to correctly calculate the centroid position, peak-top position, peak area value or other relevant values even when the number of actual measurement data forming one peak is comparatively small.

Solution to Problem

The present invention developed for solving the previously described problem is a peak waveform processing device for processing a peak waveform on a measured waveform obtained by a predetermined measurement performed on a sample, to calculate peak information for a qualitative or quantitative determination of a substance contained in the sample, the device including:

a) an upsampling processor for performing upsampling based on time-series data obtained by an actual measurement, to insert interpolation data between a pair of temporally successive data sets included in the actual measurement data; and b) a peak waveform processor for calculating at least one item of peak information selected from the centroid position, peak-top position, peak height and peak area of a peak, based on the actual measurement data and the interpolation data, both of which are obtained through the upsampling by the upsampling processor.

In the peak waveform processing device according to the present invention, the upsampling processor performs upsampling by an appropriate factor based on time-series measurement data forming a measured waveform, to insert interpolation data between the temporally successive actual measurement data. The number of data points forming one peak on the measured waveform is thereby increased. There is no specific limitation on the technique for the upsampling. For example, it is possible to use a sampling frequency conversion technique employing a digital filter or sampling converter commonly used in the areas of voice or audio processing, or to use a more versatile data interpolation technique which employs polynomial approximation, such as a Lagrange interpolation or spline interpolation. Wavelet interpolation or similar techniques may also be used.

The peak waveform processor calculates at least one item of information selected from the centroid position, peak-top position, peak height and peak area of a peak, by performing centroid processing on the peak waveform whose number of data points have been increased through the upsampling. This centroid processing is performed by an existing technique, such as an algorithm which employs trapezoidal approximation mentioned earlier. The calculated result is provided as peak information for a qualitative or quantitative analysis. The peak waveform obtained through the upsampling has a smoother curve profile. The use of such a peak waveform reduces the systematic error, i.e. the variation in the estimated centroid position which occurs with the shift of the actual peak-top position within the sampling period.

The peak waveform processing device according to the present invention is useful, for example, in the case of processing a peak waveform which emerges in the waveform of a profile spectrum obtained by a mass spectrometric analysis on a sample. In particular, the device is useful for processing a peak waveform obtained by a time-of-flight mass spectrometer in which the mass accuracy is considered as critical. Thus, in one preferable mode of the peak waveform processing device according to the present invention, the upsampling processor processes actual measurement data output from a time-of-flight mass spectrometer, and the peak waveform processor is operable to determine the centroid position of the peak, providing a mass-to-charge ratio corresponding to the centroid position as the information for qualitatively determining (identifying) a substance.

This configuration provides a high level of accuracy of the determination of the centroid position of the peak waveform on the profile spectrum, and thereby improves the accuracy of the calculation of the mass-to-charge-ratio value for each ion. Therefore, for example, the identification of a substance based on a database search can be performed with an improved level of correctness. Additionally, the deconvolution process on a multivalent ion peak can be assuredly performed, which allows for a correct determination of the valence of the multivalent ion and thereby improves the accuracy of the calculation of the mass-to-charge-ratio value of the ion.

The peak waveform processing device according to the present invention can also be used in the case of processing a peak waveform which emerges in a chromatogram waveform obtained by a liquid chromatographic or gas chromatographic analysis, and performing a quantitative determination based on the obtained peak height, peak area or other values. With the peak waveform processing device according to the present invention, the accuracy of the calculation of the peak height or peak area is also improved, so that the accuracy of the quantitative determination will also be improved.

Advantageous Effects of the Invention

With the peak waveform processing device according to the present invention, it is possible to determine peak information, such as the centroid position, centroid intensity, peak-top position, peak height or peak area of a peak on a measured waveform, with a higher level of accuracy than with a conventional device. This improves the accuracy of the process of identifying a substance in a sample or determining its quantity using the peak information.

DESCRIPTION OF EMBODIMENTS

One embodiment of a mass spectrometry system using a peak waveform processing device according to the present invention is hereinafter described with reference to the attached drawings.

Figure 1:
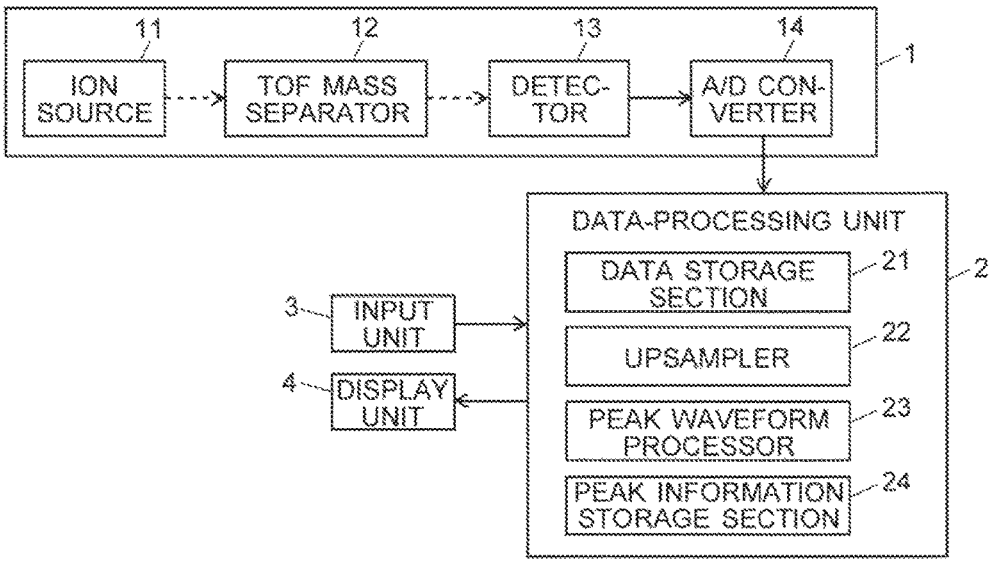
FIG. 1 is a schematic configuration diagram of one embodiment of a mass spectrometry system using a peak waveform processing device according to the present invention.

FIG. 1 is a schematic configuration diagram of the mass spectrometry system in the present embodiment.

A time-of-flight mass spectrometer (TOFMS) 1 includes an ion source 11, TOF mass separator 12, detector 13 and analogue-to-digital (A/D) converter 14. Ions generated from a sample in the ion source 11 are ejected into the TOF mass separator 12, where those ions are separated from each other in the temporal direction according to their mass-to-charge ratios. The separated ions arrive at the detector 13 with time differences and are thereby detected. Such a cycle of mass spectrometry is repeated at short intervals of time in the time-of-flight mass spectrometer 1. The detector 13 generates detection signals corresponding to the amounts of ions which sequentially arrive at the detector. Those detection signals are converted into digital data by the A/D converter 14 with a predetermined sampling period and sent to a data-processing unit 2.

The data-processing unit 2 includes a data storage section 21, upsampler 22, peak waveform processor 23, and peak information storage section 24 as its functional blocks. Additionally, an input unit 3 for allowing users to set appropriate parameters related to the data processing, and a display unit 4 for showing the processing result, are connected to the data-processing unit 2. The data-processing unit 2 is actually a personal computer, on which the functional blocks mentioned earlier can be realized by executing, on this computer, a dedicated data-processing software program previously installed on the same computer.

Figure 2:
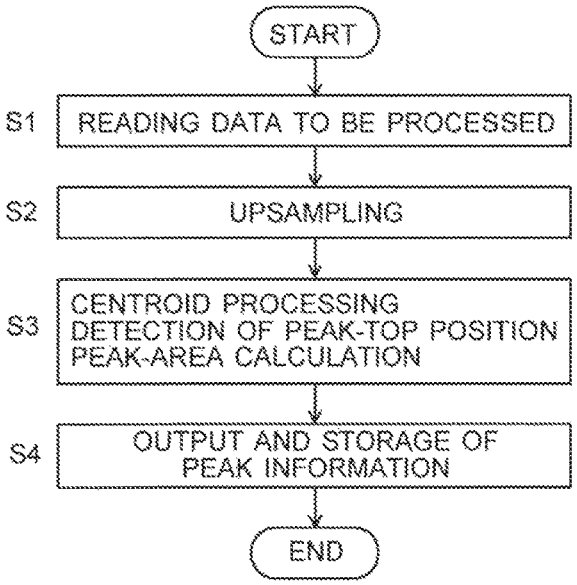
FIG. 2 is a flowchart showing the steps of the characteristic peak waveform processing in the mass spectrometry system in the present embodiment.

FIG. 2 is a flowchart showing the steps of the characteristic peak waveform processing in the mass spectrometry system in the present embodiment. The peak waveform processing is hereinafter described according to FIG. 2.

When the peak waveform processing is initiated, the upsampler 22 reads a set of actual measurement data which constitutes a profile spectrum, obtained by one measurement, from the data storage section 21 in the order of time (Step S1). Subsequently, the upsampler 22 performs the upsampling process by a factor of two, for example, to insert computationally estimated data between the successive measurement data (Step S2).

For the upsampling, sampling frequency conversion techniques which are commonly used in the areas of voice or audio processing may be used. Specifically, the oversampling which uses a digital filter, or a sampling converter, can be used. More versatile sampling frequency conversion techniques may also be used, such as the calculation of interpolation points by a local polynomial approximation. Frequency-domain interpolation is also suitably applicable to a peak waveform as obtained in the present case. Accordingly, for example, wavelet interpolation can also be used. Needless to say, the upsampling may be performed by any appropriate factor, such as a factor of four in place of two.

Figure 3:
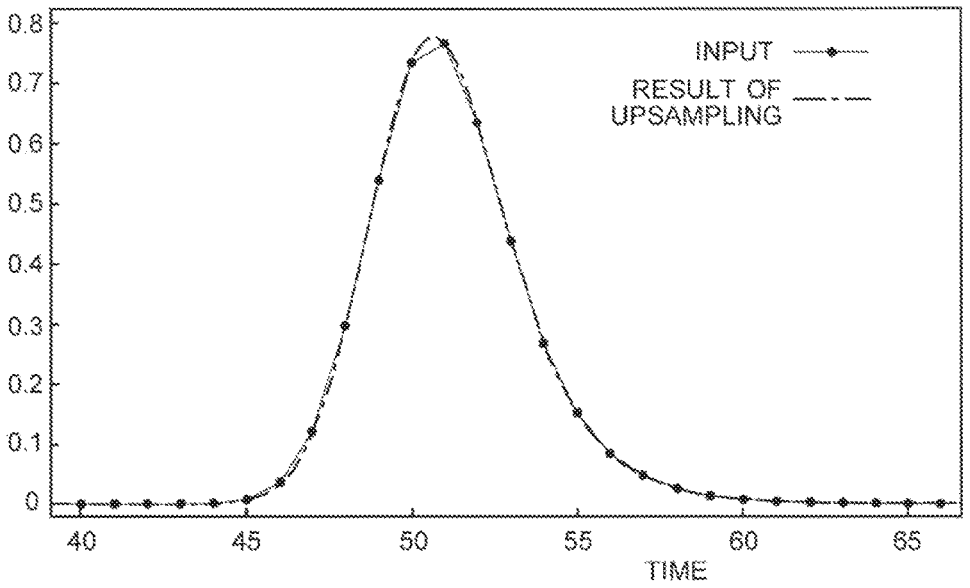
FIG. 3 is a graph showing actual measurement data and a peak waveform obtained through an upsampling process based on the data.

FIG. 3 is a diagram showing a peak waveform obtained by repeating the upsampling by a factor of 4/3 as the sampling frequency conversion process 14 times. Increasing the upsampling factor yields a higher level of accuracy yet takes a corresponding amount of computing time. The factor should be previously determined in consideration of the tradeoff between accuracy and time.

Subsequently, the peak waveform processor 23 performs the centroid processing on the upsampled data, i.e. on a peak waveform formed by the actual measurement data and the computationally estimated interpolation data, in a similar manner to the conventional technique, to determine the centroid peak and calculate its peak-top position, peak-area value and other related values (Step S3). The obtained results are stored as peak information in the peak information storage section 24 as well as displayed on the screen of the display unit 4 (Step S4). For the centroid processing, the previously described method which employs trapezoidal approximation can be used, or any commonly known method for the peak position calculation may also be used, such as the polynomial approximation of the peak waveform followed by the determination of a point at which the differential value becomes zero.

Figure 4:
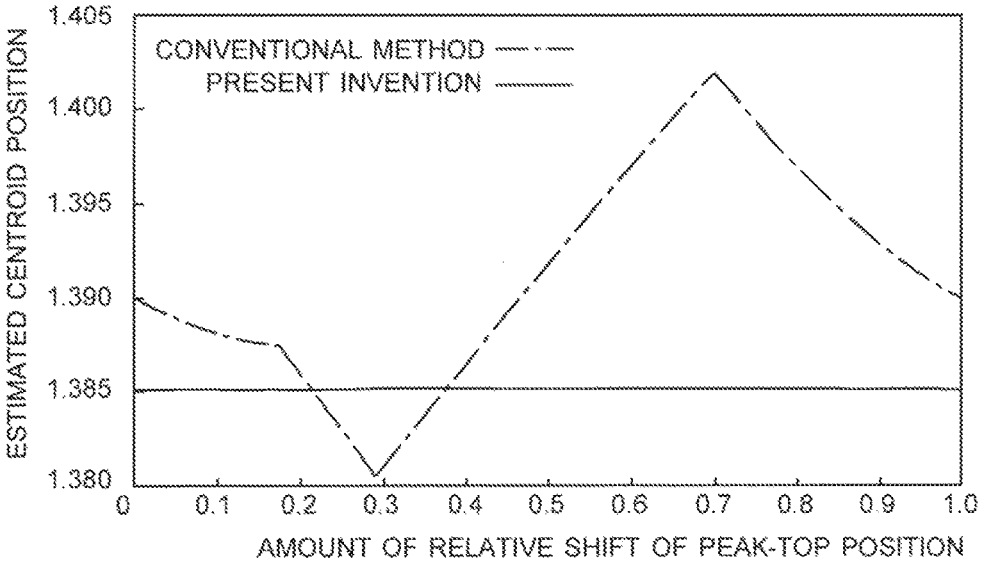
FIG. 4 is a graph showing the relationship between the amount of relative shift of the actual peak-top position within the sampling period and the estimated centroid position in the case of the peak waveform processing according to the present embodiment (employing trapezoidal approximation) and in the case of a conventional peak waveform processing.
Figure 8:
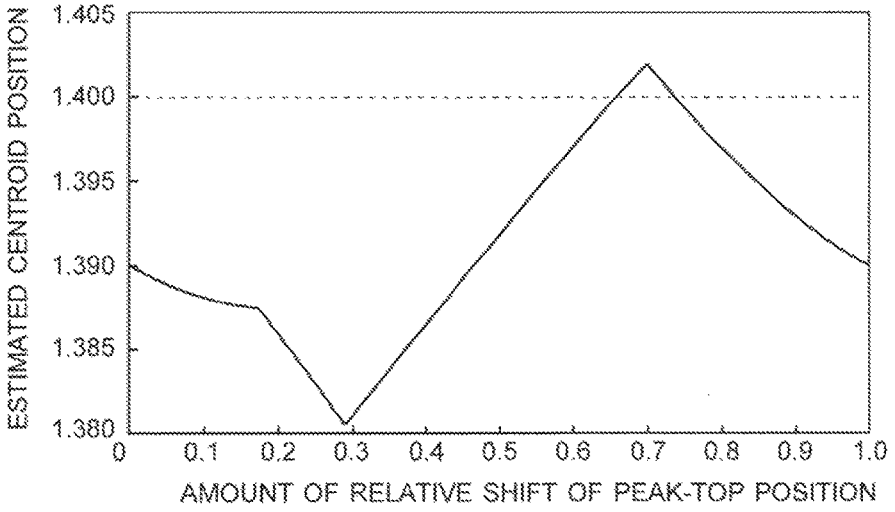
FIG. 8 is a graph showing the relationship between the amount of relative shift of the actual peak-top position within the sampling period and the estimated centroid position in the case of the conventional peak waveform processing.

FIG. 4 is a graph showing the relationship between the amount of relative shift of the actual peak-top position within the sampling period and the estimated centroid position, similar to FIG. 8. The long dashed short dashed line represents the result obtained by a conventional technique (the same as shown in FIG. 8), while the solid line represents the result obtained by a technique according to the present invention in which the centroid processing by trapezoidal approximation was performed after the upsampling. As is evident from the graph, the centroid position determined by the technique according to the present invention is almost constantly located at the same position regardless of the actual peak-top position. This means that the systematic error in estimating the centroid position has been reduced.

Figure 5:
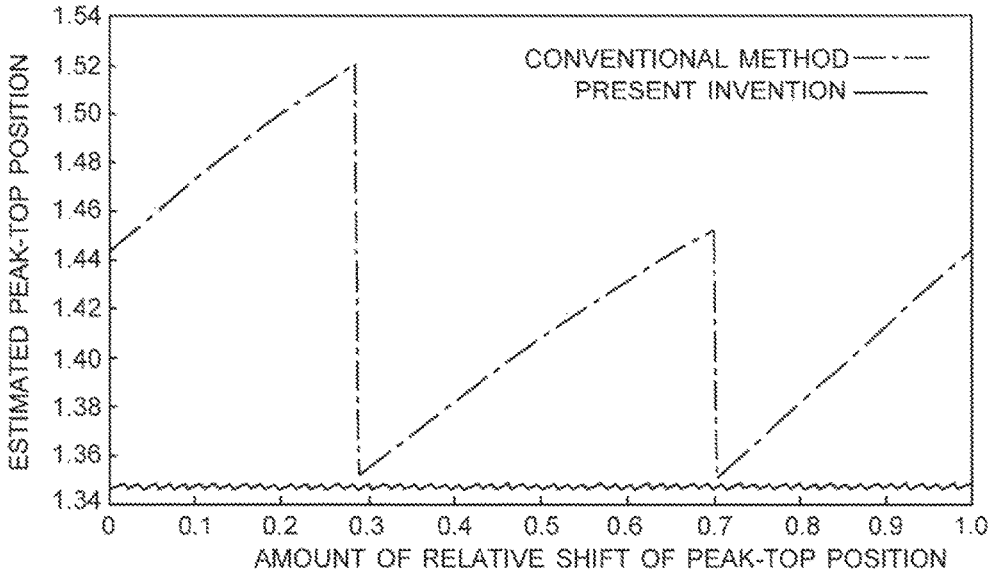
FIG. 5 is a graph showing the relationship between the amount of relative shift of the actual peak-top position within the sampling period and the estimated peak-top position in the case of the peak waveform processing according to the present embodiment (employing polynomial approximation) and in the case of a conventional peak waveform processing.

FIG. 5 is a graph showing the relationship between the amount of relative shift of the actual peak-top position within the sampling period and the estimated peak-top position. The long dashed short dashed line represents the result obtained by a conventional technique, while the solid line represents the result obtained by a technique according to the present invention in which a peak-position detection by multinomial approximation was performed after the upsampling. As is evident from the graph, the systematic error in estimating the peak detection position is also reduced in the case where the peak position detection by multinomial approximation was used in place of the centroid processing by trapezoidal approximation after the upsampling.

Figure 6:
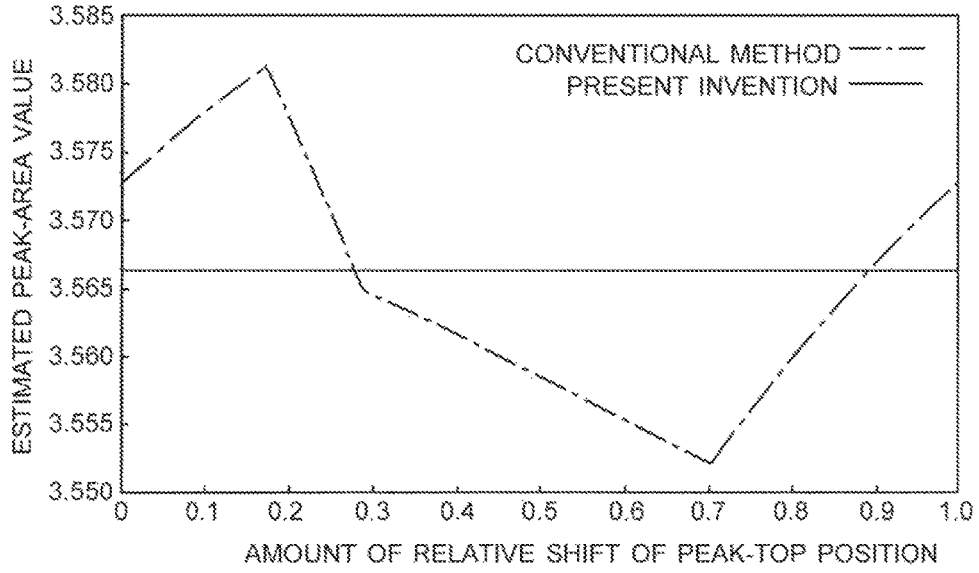
FIG. 6 is a graph showing the relationship between the amount of relative shift of the actual peak-top position within the sampling period and the calculated peak-area value in the case of the peak waveform processing according to the present embodiment (employing trapezoidal approximation) and in the case of a conventional peak waveform processing.
Figure 7:
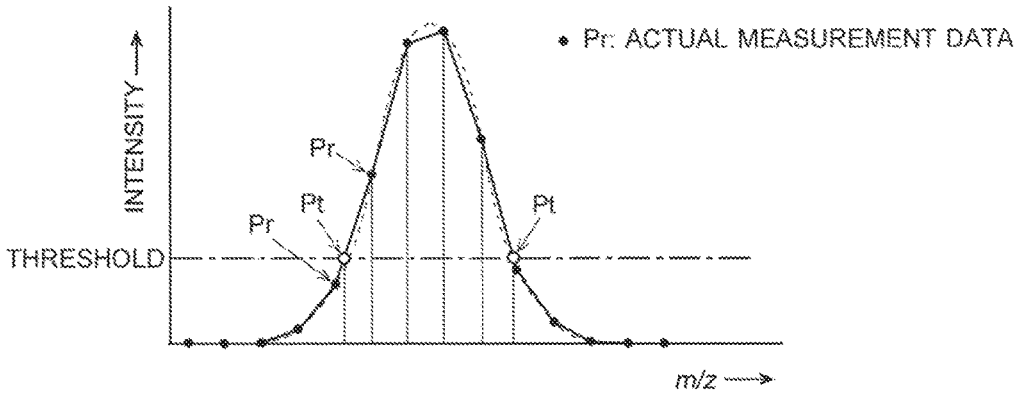
FIG. 7 is a schematic diagram illustrating an algorithm for the centroid processing which employs a trapezoidal approximation.

FIG. 6 is a graph showing the relationship between the amount of relative shift of the actual peak-top position within the sampling period and the calculated peak-area value. The long dashed short dashed line represents the result obtained by a conventional technique, while the solid line represents the result obtained by a technique according to the present invention in which a peak area calculation by trapezoidal approximation was performed after the upsampling. As is evident from the graph, the systematic error has also been sufficiently reduced not only in the estimation of the centroid position or peak-top position but also in the calculation of the peak area.

For example, the peak information calculated on the basis of a profile spectrum obtained by a mass spectrometric analysis in the previously described manner is used for the identification (qualitative determination) of a substance in a sample. That is to say, the mass-to-charge-ratio value of an ion corresponding to the peak is obtained from the centroid position determined by the centroid processing, and this mass-to-charge-ratio value can be used for a database search based on a compound database to extract a compound corresponding to that mass-to-charge ratio and present it as the identification result. The use of the mass-to-charge-ratio value determined with a high level of accuracy improves the accuracy of the database search, so that the situation with the substance being unidentifiable or incorrectly identified can be avoided.

In the previous embodiment, the present invention is applied in the processing of a peak waveform in a profile spectrum obtained by a mass spectrometric analysis. The present invention can also be applied in the processing of a peak waveform in a chromatogram obtained by a liquid chromatographic analysis or similar analysis, to improve the accuracy of the calculation of the peak area or peak height. In that case, the accuracy of the quantitative determination using those values will be improved.

It should be noted that any of the previous embodiments is a mere example of the present invention, and any change, modification or addition appropriately made within the spirit of the present invention will naturally fall within the scope of claims of the present application.

REFERENCE SIGNS LIST

1 . . . Time-of-Flight Mass Spectrometer
11 . . . Ion Source
12 . . . TOF Mass Separator
13 . . . Detector
14 . . . Analogue-to-Digital Converter
2 . . . Data-Processing Unit
21 . . . Data Storage Section
22 . . . Upsampler
23 . . . Peak Waveform Processor
24 . . . Peak Information Storage Section
3 . . . Input Unit
4 . . . Display Unit

The invention claimed is:

1. A peak waveform processing device for processing a peak waveform on a measured waveform obtained by a predetermined measurement performed on a sample, to calculate peak information for a qualitative or quantitative determination of a substance contained in the sample, the device comprising:

a) an upsampling processor for performing upsampling based on time-series data obtained by an actual measurement, to insert interpolation data between a pair of temporally successive data sets included in the actual measurement data; and b) a peak waveform processor for calculating at least one item of peak information selected from a centroid position, peak-top position, peak height and peak area of a peak, based on the actual measurement data and the interpolation data, both of which are obtained through the upsampling by the upsampling processor.

2. The peak waveform processing device according to claim 1, wherein:

the upsampling processor processes actual measurement data output from a time-of-flight mass spectrometer, and the peak waveform processor is operable to determine the centroid position of the peak, providing a mass-to-charge ratio corresponding to the centroid position as information for qualitatively determining a substance.

* * * * *